US009814946B2

(12) United States Patent
Yamasawa et al.

(10) Patent No.: US 9,814,946 B2
(45) Date of Patent: Nov. 14, 2017

(54) GOLF CLUB HEAD

(71) Applicant: DUNLOP SPORTS CO. LTD., Kobe-shi, Hyogo (JP)

(72) Inventors: Kota Yamasawa, Kobe (JP); Kiyofumi Matsunaga, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/645,036

(22) Filed: Mar. 11, 2015

(65) Prior Publication Data

US 2015/0265887 A1 Sep. 24, 2015

(30) Foreign Application Priority Data

Mar. 24, 2014 (JP) ..... 2014-060426

(51) Int. Cl.
*A63B 53/04* (2015.01)

(52) U.S. Cl.
CPC .. *A63B 53/0466* (2013.01); *A63B 2053/0408* (2013.01); *A63B 2053/0416* (2013.01)

(58) Field of Classification Search
CPC ..... A63B 2053/0408; A63B 53/04
USPC ..... 473/342, 350, 345, 344, 349
See application file for complete search history.

(56) References Cited

U.S. PATENT DOCUMENTS 6,719,643 B1 * 4/2004 Helmstetter ..... A63B 53/04 473/305
6,719,645 B2 * 4/2004 Kouno ..... A63B 53/04 473/345
7,614,964 B2 * 11/2009 Matsunaga ..... A63B 53/0466 473/342
8,047,931 B2 * 11/2011 Yokota ..... A63B 53/0466 473/342
2008/0248896 A1 10/2008 Hirano
2010/0317460 A1 * 12/2010 Hirano ..... A63B 53/0466 473/342

FOREIGN PATENT DOCUMENTS

JP 2004-290274 A 10/2004
JP 2004290274 A * 10/2004 ..... A63B 53/04
JP 2008-253564 A 10/2008

* cited by examiner

*Primary Examiner* — Aarti B Berdichevsky
*Assistant Examiner* — Rayshun Peng
(74) *Attorney, Agent, or Firm* — Birch, Stewart, Kolasch & Birch, LLP

(57) ABSTRACT

A golf club head has a hollow structure composed of a head main body including a face portion provided with an opening and a face member fitted in the opening and welded to the head main body. The welded part between the face member and the head main body includes a crown-side welded part positioned substantially at the upper edge or alternatively spaced apart from the upper edge toward the lower edge by a certain distance, and a sole-side welded part spaced apart from the lower edge toward the upper edge by a certain distance which is more than zero and more than the distance. The face portion is provided between the sole-side welded part and the lower edge with a sole-side thin area whose thickness is less than a thickness of the face member.

10 Claims, 8 Drawing Sheets

GOLF CLUB HEAD

TECHNICAL FIELD

The present invention relates to a golf club head capable of exerting high rebound performance.

BACKGROUND ART

In Japanese Patent Application Publication No. 2008-253564, a golf club head having a hollow structure is disclosed, wherein a cup-shaped face member including a face portion and a turnback extending backwardly therefrom is welded to a head main body having an opening in its front side. such club head has a problem of high production cost.

In Japanese Patent Application Publication No. 2004-290274, a golf club head having a hollow structure is disclosed which comprises a head main body including a face portion provided with an opening, and a platy face member fitted in the opening and welded to the head main body. In such club head, the production cost can be reduced because the face member is a simple plate.

SUMMARY OF INVENTION

Technical Problem

By the way, a hollow golf club head as typified by a fairway wood has more opportunities to hit a golf ball in a lower part of the club face.

Therefore, in order to effectively improve the rebound performance of a golf club head when a ball is hit by such a lower part, there has been sought a technique though which a thin area of the face portion can be stably formed on the sole side of a platy face member.

The present invention was made with the view to the above-mentioned problem, and a primarily object of the present invention is to provide a golf club head which can exert excellent rebound performance although a platy face member is employed.

Solution to Problem

According to the present invention, a golf club head has a hollow structure comprising a face portion for hitting a ball, a crown portion connecting the face portion at an upper edge thereof and forming an upper surface of the club head, and a sole portion connecting the face portion at a lower edge thereof and forming an under surface of the club head, and the golf club head is composed of a head main body including a part of the face portion provided with an opening, and a face member fitted in the opening and welded to the head main body, wherein a welded part between the face member and the head main body includes a crown-side welded part positioned substantially at the upper edge or alternatively spaced apart from the upper edge toward the lower edge by a certain distance (A), and a sole-side welded part spaced apart from the lower edge toward the upper edge by a certain distance B which is more than zero and more than the distance (A), and the face portion is provided between the sole-side welded part and the lower edge with a sole-side thin area whose thickness is less than a thickness of the face member.

Further, the golf club head according to the present invention may have the following features (1)-(5):

(1) the face portion is provided between the crown-side welded part and the upper edge with a crown-side thin area whose thickness is less than the thickness of the face member, and the thickness of the sole-side thin area is less than the thickness of the crown-side thin area;

(2) the thickness of the sole-side thin area is 0.5 to 2.0 mm;

(3) the distance B is not less than 5 mm, and the distance (A) is not more than 3 mm;

(4) the distance B is not less than 15% of a height of the club head, and the distance (A) is not more than 5% of the height of the club head;

(5) the thickness of the sole-side thin area is 70% to 95% of the thickness of the face member.

Therefore, in the golf club head according to the present invention, the sole-side thin area can be bent effectively when a ball hits a lower part of the face portion. As a result, the golf club head can exerts excellent rebound performance. Since the crown-side welded part is positioned at or relatively close to the upper edge, the face member can extend largely in the up-down direction of the head, which makes it possible for the face member to effectively exert its material characteristics to improve the rebound performance.

DEFINITIONS

In this description, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the specified lie angle alpha while keeping the axis on a vertical plane, and the face forms the specified loft angle with respect to the horizontal plane HP.

Incidentally, in the case of the club head alone, the center line CL of the shaft inserting hole 6*a* can be used instead of the axis of the club shaft.

"Front-back direction" is a direction parallel with a straight line N projected on the horizontal plane HP, wherein the straight line N is drawn normally to the club face F passing through the center G of gravity of the club head.

"Toe-heel direction" is a direction parallel with the horizontal plane HP and perpendicular to the front-back direction.

"Sweet spot SS" is the point of intersection between the club face F and the straight line N drawn normally to the club face F passing the center G of gravity of the head.

"Edge" of the face portion 2 (or club face F): If the edge (2A, 2B, 2*c*, 2D) is unclear due to smooth change in the curvature of the club face F, a virtual edge line (P) which is defined based on the curvature change, is used instead as follows. As shown in FIGS. 4(*a*) and 4(*b*), in each cutting plane E1, E2 —including the straight line N extending between the sweet spot SS and the center of gravity G, a point P at which the radius (r) of curvature of the profile line Lf of the face portion first becomes under 200 mm in the course from the center SS to the periphery of the club face is determined. Then, the virtual edge line is defined as a locus of the points P.

DESCRIPTION OF EMBODIMENTS

Figure 1:
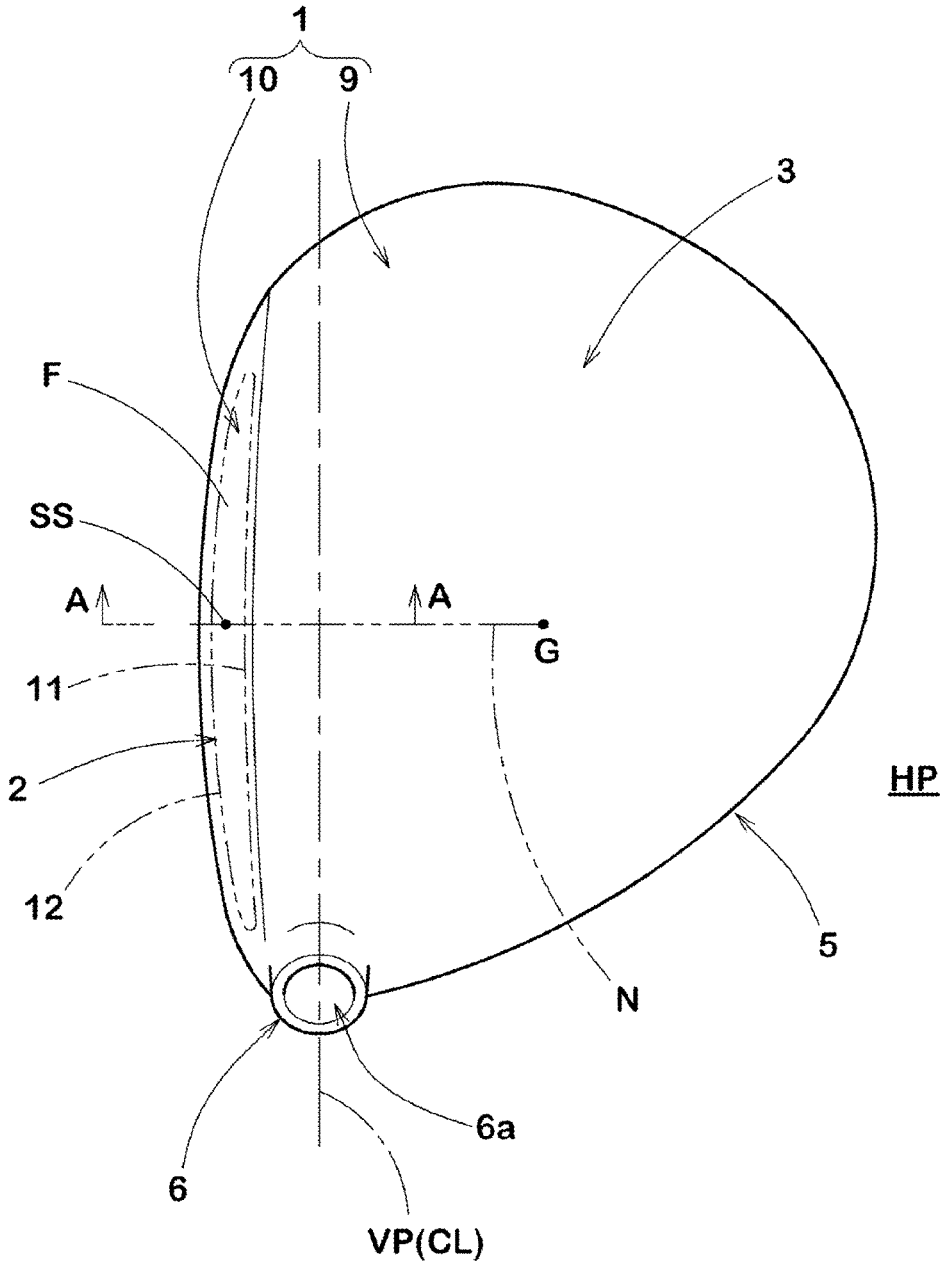
FIG. 1 is a plan view of a golf club head as an embodiment of the present invention.

Embodiments of the present invention will now be described in detail in conjunction with accompanying drawings.

Throughout all of the embodiments, same members or portions are denoted by the same reference signs or numbers.

The present invention is suitability applied to a hollow club head, especially to a hollow wood-type club head. Further, the present invention may be applied to a utility type club head. Here, the "wood-type" includes at least driver (#1) and fairway woods—brassie (2-wood), spoon (3-wood), baffy (4-wood) and cleek (5-wood). Further, a club head whose shape (outer appearance) is similar to those of the above-mentioned examples may be also included although the golf club number or name therefor is different therefrom.

In the drawing, the club head 1 according to the present invention is embodied as a wood-type club head, specifically for a fairway wood.

The club head 1 has a face portion 2, a crown portion 3, a sole portion 4, a side portion 5 and a hosel portion 6.

The face portion 2 has a club face F for hitting a ball. The crown portion 3 extends from the upper edge 2A of the face portion 2, defining the upper surface of the club head 1. The sole portion 4 extends from the lower edge 28 of the face portion 2, defining the under surface of the club head 1. The side portion 5 extends between the crown portion 3 and the sole portion 4, defining the side surface of the club head 1. A toe-side part of the side portion 5 intersects the face portion 2 at the toe-side edge 2*c* of the face portion 2. A heel-side of the side portion 5 intersects the face portion 2 at the heel-side edge 2D of the face portion 2. The club face F is defined as being surrounded by the edges 2A-2D. The hosel portion 6 is a tubular part formed at the heel-side end of the crown portion 3 to be attached to an end of a club shaft (not shown) inserted into its shaft inserting hole 6*a*. Thus, the club head 1 is provided with a hollow structure having a substantially closed hollow i.

Figure 3:
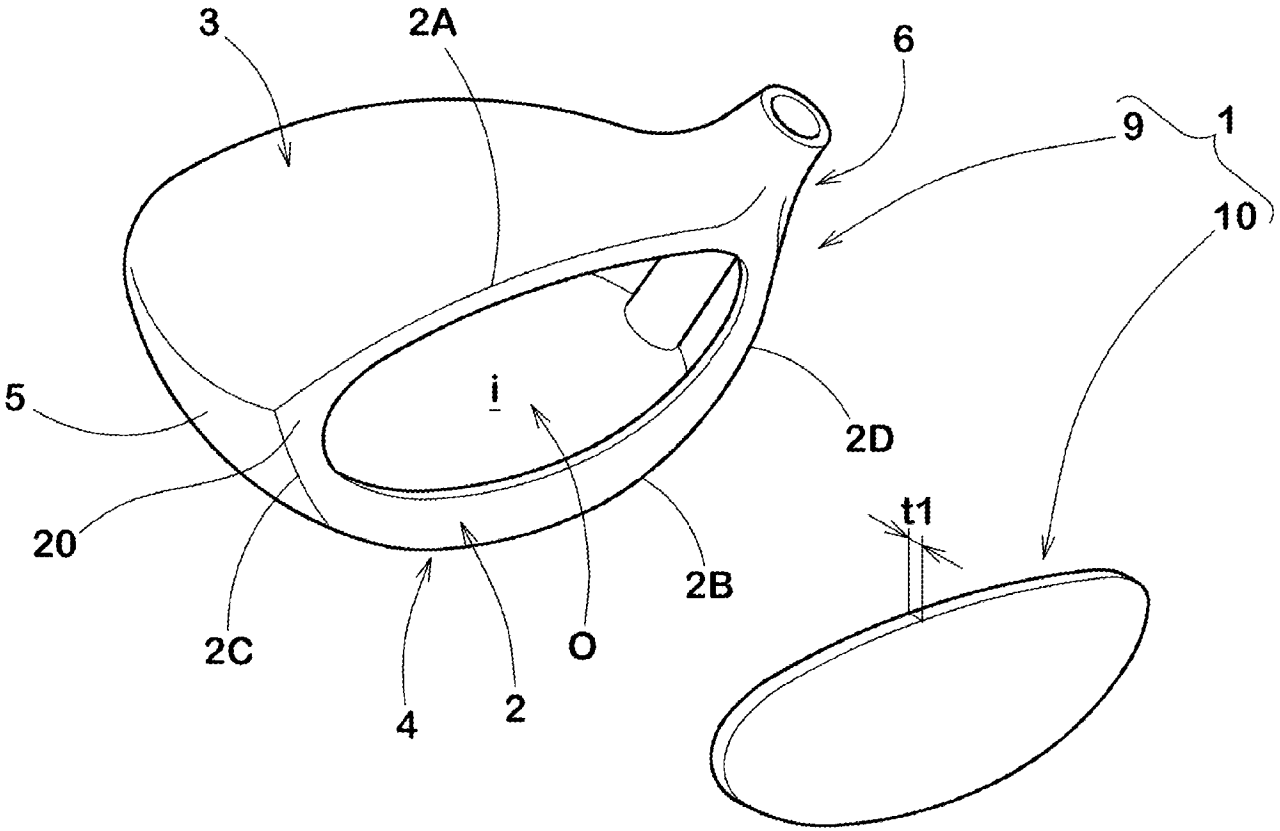
FIG. 3 is an exploded perspective view of the golf club head.
Figure 4A:
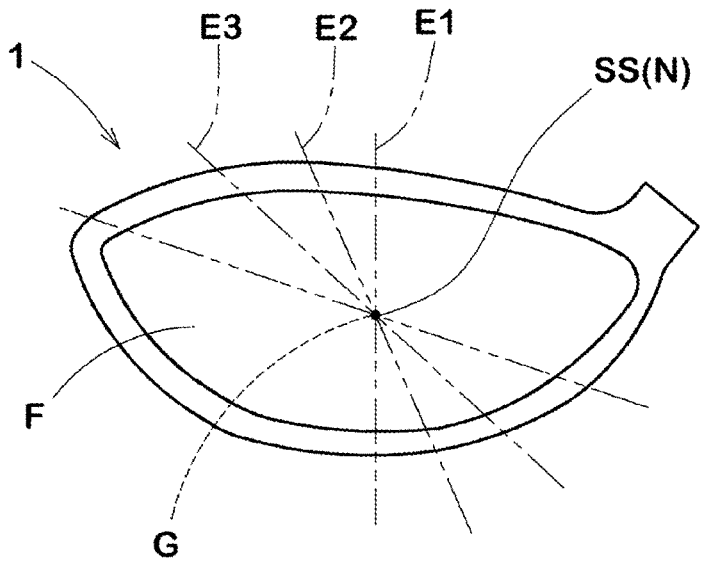
FIG. 4(*a*) and FIG. 4(*b*) are a front view and a cross sectional view, respectively, of a golf club head for explaining the edge of the face portion.
Figure 4B:
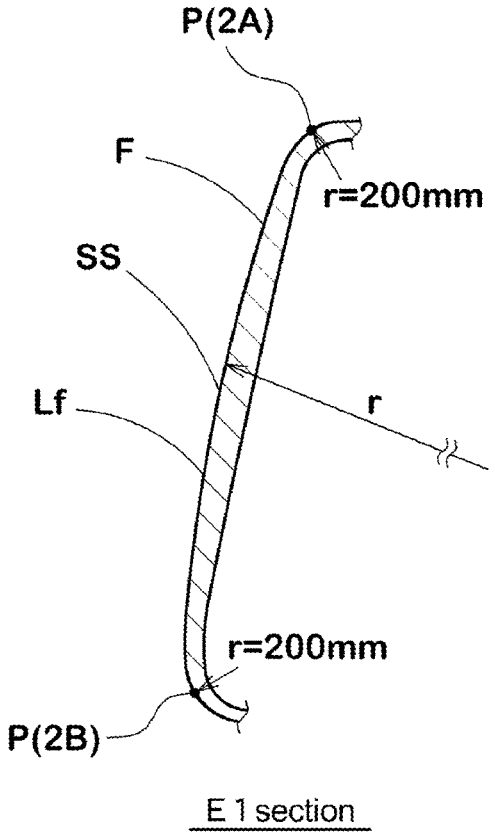
Figure 8:
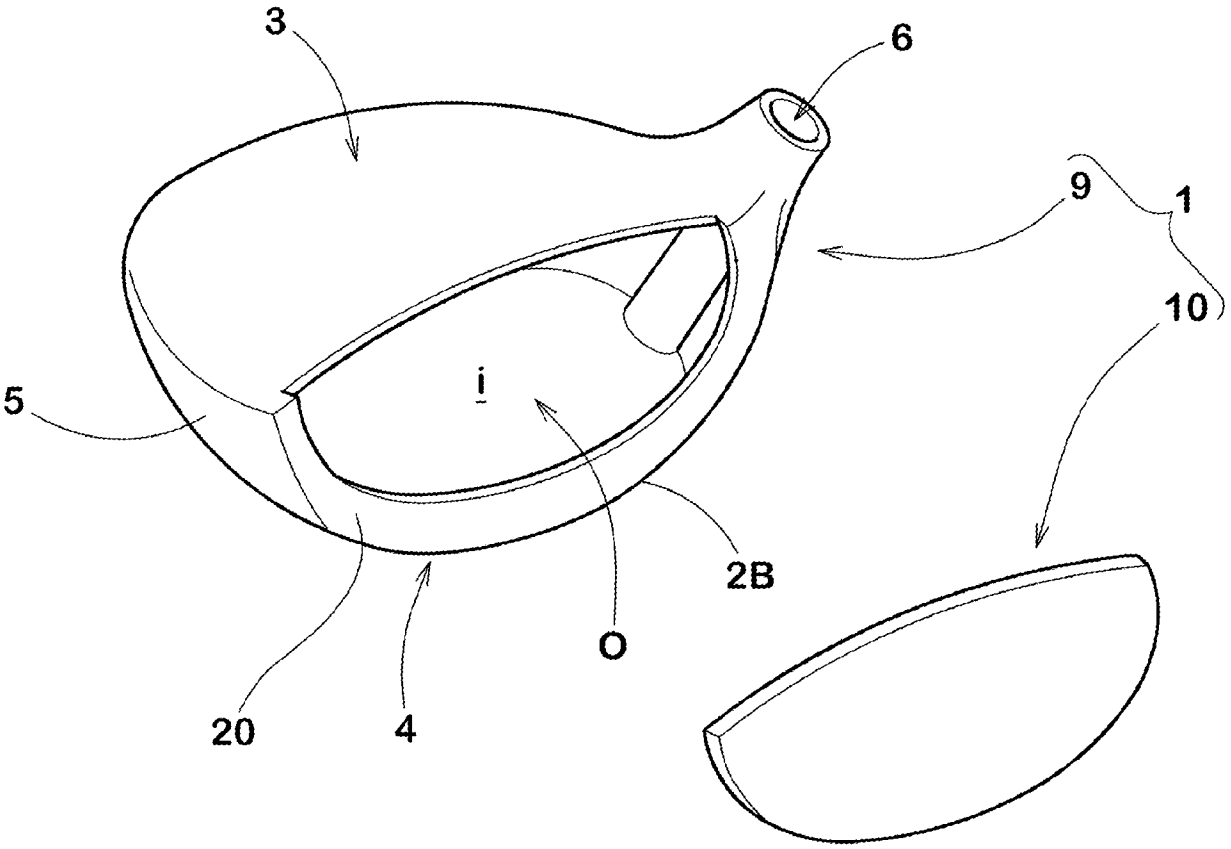
FIG. 8 is a perspective view showing a face member and a head main body of a golf club head as another embodiment of the present invention.

The club head 1 is, as shown in FIG. 3 or FIG. 8, composed of a head main body 9 including a part of the face portion 2 in which an opening O is formed, and a face member 10 fitted in the opening O so as to close the opening O and fixed to the head main body 9. The above-mentioned opening O is formed so that the sweet spot SS is positioned in the opening O.

The head main body 9 in this example is made of a metal material. In this case, it is preferable that the head main body 9 is manufactured by integral moulding as a cast. But, the head main body 9 can be manufactured by assembling two or more separate parts each formed through an appropriate technique, e.g. forging, casting, press working, rolling and the like, and then combining together into one for example utilizing a welding technique.

As to the metal material of the head main body 9, for example, stainless alloy, maraging steel, titanium, titanium alloy, magnesium alloy, aluminum alloy and the like may be preferably used alone or in combination. It is also possible that the head main body 9 is partially made of a fiber reinforced resin.

Figure 2:
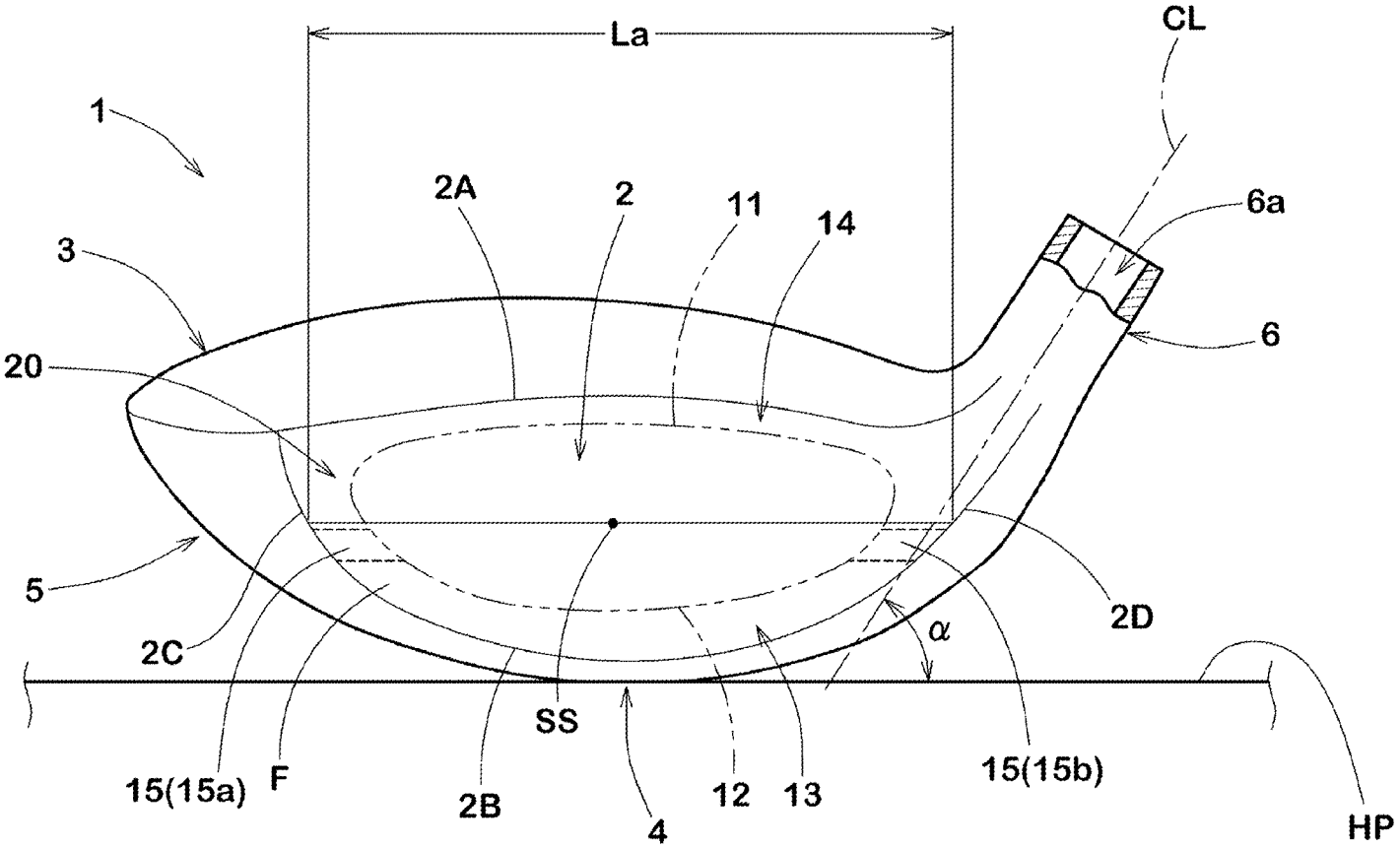
FIG. 2 is a front view of the golf club head.

In the embodiment shown in FIG. 1-FIG. 3, the above-mentioned opening O is formed within the face portion 2 so that a marginal zone 20 of the face portion 2 is continuously formed around the opening O. The head main body 9 in this the embodiment includes the marginal zone 20 of the face portion 2, the crown portion 3, the sole portion 4, the side portion 5, and the hosel portion 6. The opening O preferably has a contour shape similar to the contour shape of the club face F defined by the edges 2A-2D.

The face member 10 is made of a metal material and formed as a simple plate in order to easily manufacture it with low production cost. The face member 10 may have a variable thickness t1. But, in this example, the face member 10 has a constant thickness t1. Such face member 10 can be easily manufactured through press working of a rolled sheet metal having a constant thickness for example, therefore, it is possible to reduce the production cost of the club head 1.

As to the metal material of the face member 10, for example, stainless alloy, maraging steel, titanium, titanium alloy, magnesium alloy, aluminum alloy or the like can be preferable used.

It is preferable that the metal material of the face member 10 has a specific strength higher than that of the head main body 9. More preferably, the metal material of the face member 10 has an elastic modulus higher than that of the head main body 9.

The thickness t1 of the face member 10 is preferably not less than 1.5 mm, more preferably not less than 1.8 mm in order that the face member 10 can withstand large impactive force of a ball. But, in order to allow the face member 10 to bend appropriately when hitting a ball, it is preferred that the thickness t1 of the face member 10 is at most 3.0 mm, more preferably at most 2.5 mm.

Figure 5A:
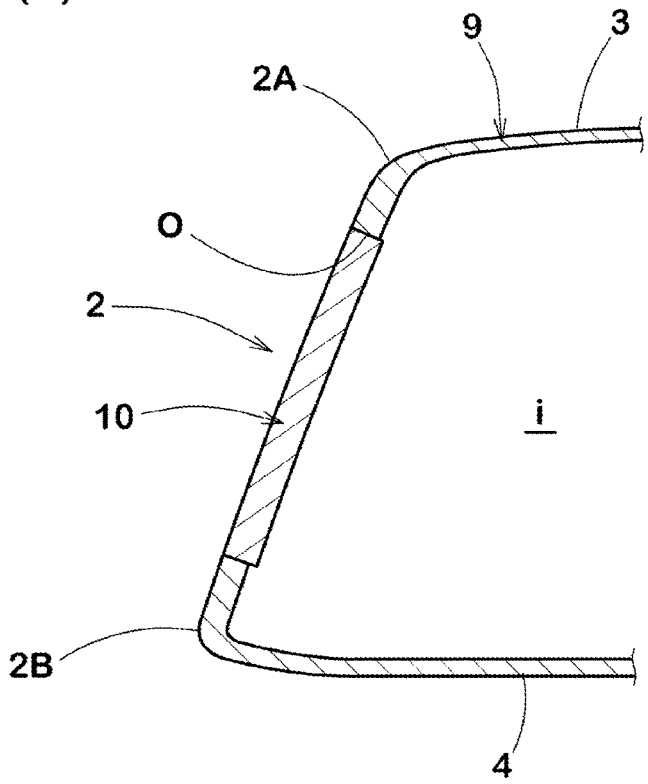
FIG. 5(*a*) and FIG. 5(*b*) are cross sectional views of the golf club head for explaining a process for welding the face member to the head main body.
Figure 5B:
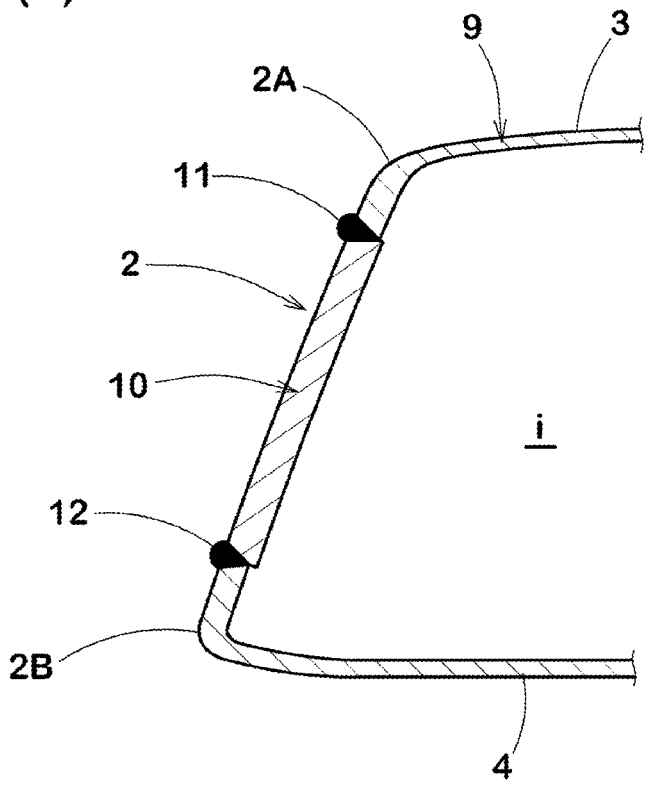
Figure 6:
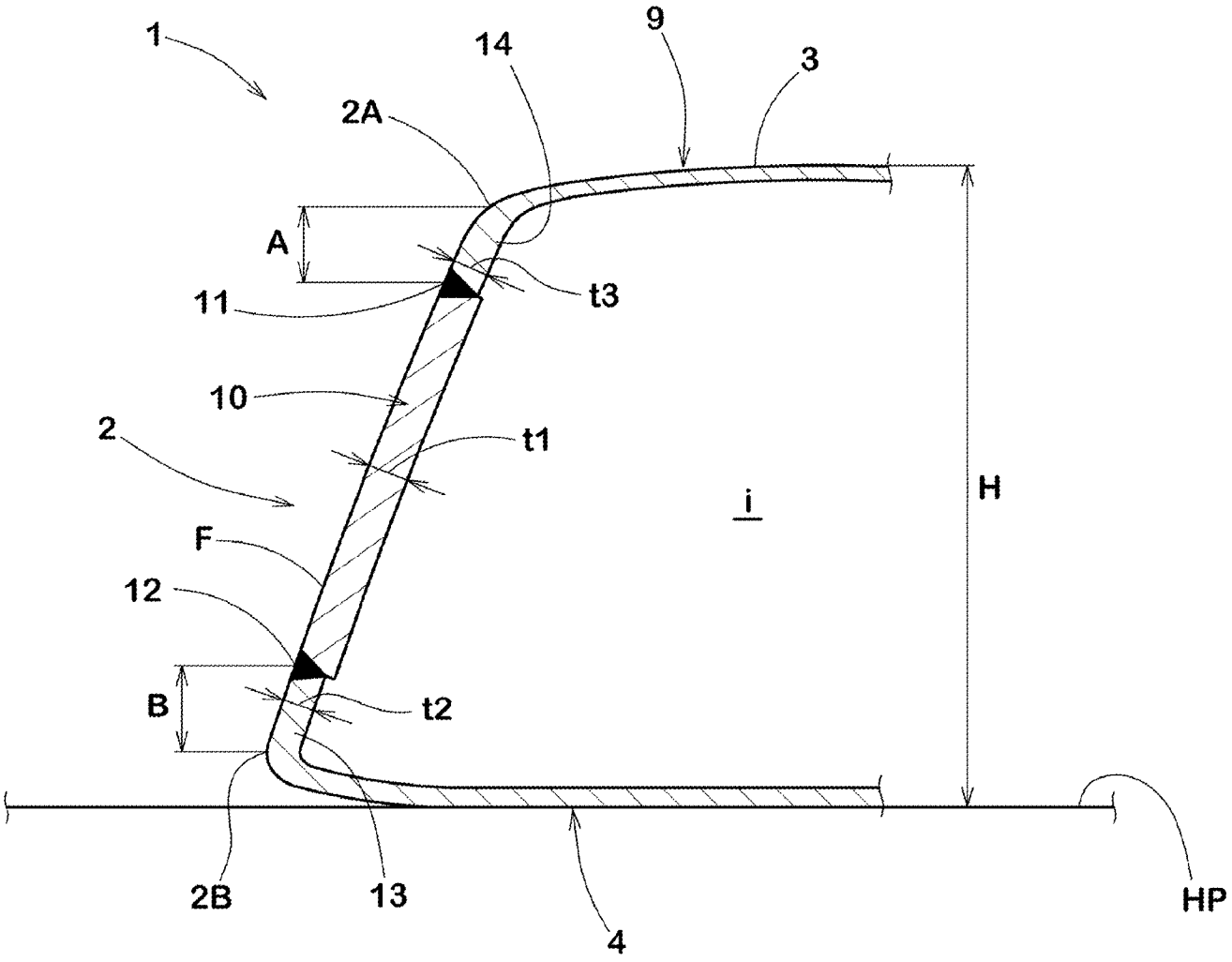
FIG. 6 is a cross sectional view of the golf club head shown in FIG. 1 taken along line A-A in FIG. 1.

The face member 10 is fixed to the head main body 9 through a welding technique, for example as follows. First, as shown in FIG. 5(*a*), the face member 10 is fitted in the opening O of the head main body 9 to be temporarily fixed thereto. Then, as shown in FIG. 5(*b*), a molten metal (shown in solid black) is filled in the gap between the face member 10 and the head main body 9. After the molten metal is cooled and hardened and thereby the face member 10 is fixed to the head main body 9, the welded part is polished by a polishing machine such as grinder so that the welded part becomes leveled with the outer surface of the finished club head 1, for example leveled with the face portion 2 as shown in FIG. 6.

The welded part between the head main body 9 and the face member 10 includes a crown-side welded part 11 and a sole-side welded part 12.

The crown-side welded part 11 extends along the upper edge 2A in almost parallel therewith.

The sole-side welded part 12 extends along the lower edge 2B in almost parallel therewith.

The sole-side welded part 12 is spaced apart from the lower edge 2B by a certain distance B, and between the sole-side welded part 12 and the lower edge 2B, a sole-side thin area 13 whose thickness t2 is less than the thickness t1 of the face member 10 is formed.

The crown-side welded part 11 is spaced apart from the upper edge 2A by a certain distance (A) which is smaller than the distance B as in the embodiment shown in FIG. 2 and FIG. 3, or the crown-side welded part 11 is positioned substantially at or close to the upper edge 2A (distance (A) is a very small value or zero) as in the embodiment shown in FIG. 8.

In the club head 1 constructed as above, since the relatively large distance B is provided on the sole side of the face member 10, it is possible to form the sole-side thin area 13 between the lower edge 2B and the crown-side welded part 11 over a wide range in the toe-heel direction without being affected by the thickness of the sole-side welded part 12 and the heat during welding. Therefore, if a ball hits a sole-side part of the club face F, the sole-side thin area 13 is suitably bent, and the club head 1 can exert excellent rebound performance. As the crown-side welded part 11 is formed at the relatively close position to the upper edge 2A, the face member 10 may have a large size in the up-down direction of the club head 1, therefore, the face member 10 can effectively exert its material characteristics to improve the rebound performance of the club head 1.

In the polishing operation after the welding operation, it is almost impossible from a practical standpoint to trim only the weld bead protruding from the outer surface of the club head 1. It is unavoidable that the vicinity of the welded part is also removed more or less. But, as the sole-side thin area 13 is broad because of the relatively large distance B, the variation of the thickness of the sole-side thin area 13 due to the polishing operation becomes small for the sole-side thin area 13 as a whole. Thus, the sole-side thin area 13 can be stably formed on the sole side of the platy face member.

In order to effectively derive the above-mentioned advantageous effect, in this embodiment, namely, in the case of the club head for a fairway wood, it is preferable that the distance (A) is not more than 3 mm, and the distance B is not less than 5 mm, but the distance B is preferably not more than 8 mm to avoid the face member 10 from being excessively decreased in the size.

In another embodiment and even in this embodiment (fairway wood), the distance (A) and the distance B may be determined in relation to the height H of the club head measured vertically from the horizontal plane HP to the highest point of the crown portion 3. More specially, the distance (A) is preferably not more than 5% of the club head height H, and the distance B is preferably not less than 15% of the club head height H in order to effectively derive the above-mentioned advantageous effect. But, the distance B is preferably not more than 20% on the club head height H in order to avoid the face member 10 from being excessively decreased in the size.

Figure 7:
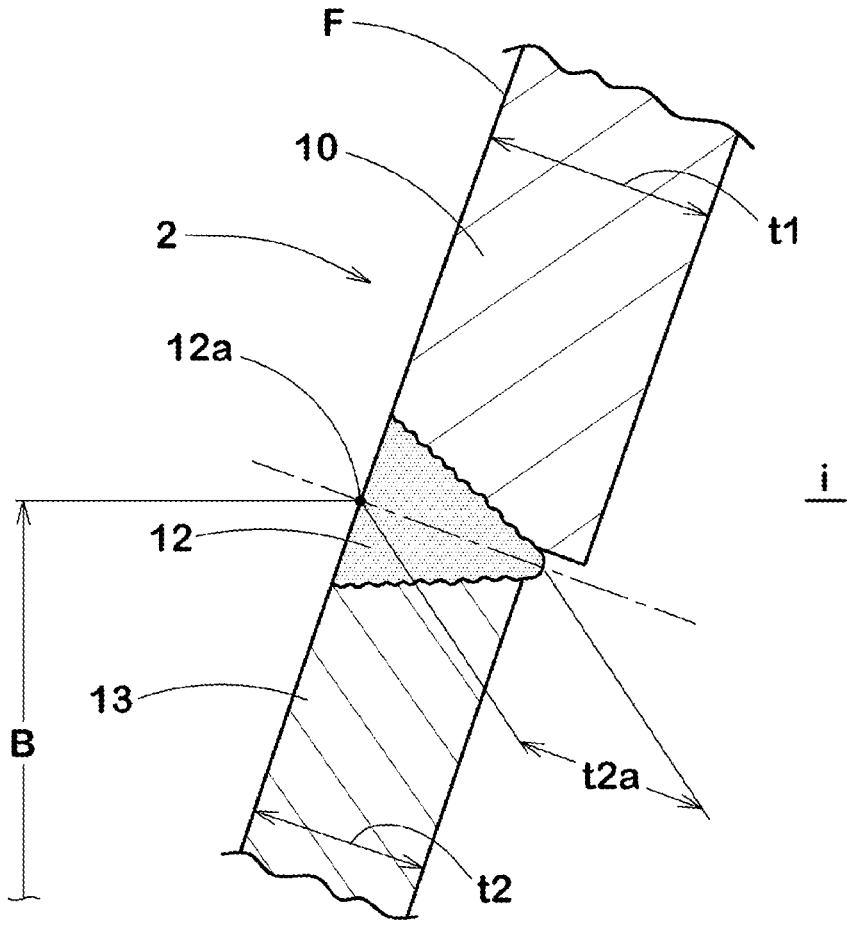
FIG. 7 is an enlarged cross sectional view of the sole-side welded part shown in FIG. 6.

In the club face F, the sole-side welded part 12 has a certain width as shown in FIG. 7. The above-mentioned distance B is defined by a distance measured in the up-down direction between the widthwise center 12*a* of the sole-side welded part 12 appearing in the club face F and the lower edge 2B of the face portion 2. Similarly, the distance (A) is defined by a distance measured in the up-down direction between the widthwise center of the crown-side welded part 11 (if appearing in the club face F) and the upper edge 2A of the face portion 2.

Preferably, the sole-side thin area 13 has a thickness t2 in a range of from 0.5 to 2.0 mm. If less than 0.5 mm, there is a possibility that the durability of the face portion 2 becomes insufficient. If more than 2.0 mm, it becomes difficult to improve the rebound performance because the face portion 2 can not be bent effectively even if a ball hits the sole-side area of the club face F.

For the same reason, the thickness t2 is preferably in a range of from 70% to 95% of the thickness t1 of the face member 10.

In the sole-side welded part 12, as shown in FIG. 7, the molten metal reaches to the hollow i of the club head 1.

By the filled hardened metal (molten metal) between the sole-side thin area 13 and the face member 10, the face portion 2 is provided at the position of the sole-side welded part 12 with a part having a thickness t2*a* more than the thickness t2 of the sole-side thin area 13 and less than the thickness t1 of the face member 10. Such part makes the thickness change in the face portion 2 gradual which helps to improve the durability of the face portion 2.

The ratio L1/La of the length L1 of the sole-side thin area 13 measured in the toe-heel direction to the length La of the club face F measured in the toe-heel direction at the position of the sweet spot SS, is preferably set in a range of not less than 50%, more preferably not less than 60%, but not more than 90%, more preferably not more than 80%.

As explained above, by forming the sole-side thin area 13 widely in the toe-heel direction, the club head can exert excellent rebound performance even if the ball hitting position is varied in the toe-heel direction.

If the above-mentioned distance (A) is not zero as shown in FIG. 6, the face portion 2 is preferably provided between the upper edge 2A and the crown-side welded part 11 with a crown-side thin area 14 whose thickness t3 is less than the thickness t1 of the face member 10 in order to further improve the rebound performance of the club head 1 in cooperation with the sole-side thin area 13.

The crown-side thin area 14 can decrease the mass of the club head 1 in its upper part, which helps to lower the position of the center of gravity of the head.

In order to effectively derive the above-mentioned advantageous effect, the thickness t3 of the crown-side thin area 14 is preferably set in a range of 0.6 to 1.8 mm.

In comparison with the sole-side thin area 13, the crown-side thin area 14 has less opportunities to hit a golf ball. Therefore, the thickness t3 of the crown-side thin area 14 can be more than the thickness t2 of the sole-side thin area 13 in order to increase the durability of the face portion.

The ratio L2/La of the length L2 of the crown-side thin area 14 measured in the toe-heel direction the above-mentioned length La of the club face F is preferably not less than 80%, more preferably not less than 90%.

In order that the rigidity change between the sole-side thin area 13 and the crown-side thin area 14 becomes gradual and thereby to avoid stress concentration and further improve the durability of the face portion 2, the marginal zone 20 is preferably provided between the sole-side thin area 13 and the crown-side thin area 14 with transitional parts 15 whose thickness gradually increases from the sole-side thin area 13 to the crown-side thin area 14.

The thickness transitional parts 15 include a toe-side thickness transitional part 15*a* and a heel-side thickness transitional part 15*b*.

In the embodiment shown in FIG. 8, the upper edge of the opening O is positioned at the upper edge 2A of the face portion 2. Accordingly, the crown-side welded part 11 is formed at the upper edge 2A. Namely, the above-mentioned distance (A) is zero. In this embodiment, the size of the face member 10 in the up-down direction can be further increased, therefore, it is possible for the face member to effectively exert its material characteristics to improve the rebound performance.

While description has been made of preferred embodiments of the present invention, the present invention can be carried out by modifying into various embodiments without being limited to the above-described concrete embodiments.

Comparison Tests

Based on the structure shown in FIG. 1-FIG. 3 and FIG. 6, hollow club heads for fairway wood were experimentally manufactured and tested for the rebound performance and durability.

Specifications of the club heads are listed in Table 1. Common specifications are as follows.

lie angle: 58 degrees
loft angle: 15 degrees
club head mass: 200 g
head main body's material: Ti-8Al-1Mo-1V
face member's material: alpha+beta type titanium alloy Ti-(5.0-5.5)Al-1Fe (TIx 51AF manufactured by Nippon steel & Sumitomo metal corporation)
face member's thickness t1: 2.0 mm (constant)
distance A: 3 mm <Rebound Performance Test>

According to the "Procedure for measuring the velocity Ratio of a Club Head for conformance to Rule 4-1e, Appendix II, Revision 2 (Feb. 8, 1999), united states Golf Association.", the restitution coefficient "e" was measured at the following three ball hitting positions: sweet spot SS, and 15% and 30% of the club head height H below the sweet spot SS. Then, the mean value for the three positions was obtained.

The obtained mean value is indicated in Table 1 by an index based on the mean value of the comparative example head Ref.1 being 100, wherein the larger the index number, the better the rebound performance.

<Durability Test>

Each head was attached to a FRP shaft to make a 43-inch fairway wood, and the golf club was mounted on a swing robot. Then, the head hit golf balls up to 3000 times at a head speed of 50 meter/second, while checking the face portion for cracks. The results are shown in Table 1, wherein "1" means that crack was found, "2" means that no crack was found, but the face portion showed signs of cracks after the 3000-time hitting test, and "3" means that no crack was found after the 3000-time hitting test.

TABLE 1

| Head | Ref.1 | Ref.2 | Ex.1 | Ex.2 | Ex.3 |
|---|---|---|---|---|---|
| distance B (mm) | 3 | 5 | 5 | 8 | 10 |
| sole-side thin area thickness t2 (mm) | 1.7 | 2.0 | 1.7 | 1.7 | 1.7 |
| rebound performance | 100 | 90 | 110 | 110 | 110 |
| durability | 2 | 3 | 3 | 3 | 2 |

From the test results, it was confirmed that the club heads Ex.1-Ex.3 according to the present invention were improved in the rebound performance in comparison with the comparative examples Ref.1 and Ref.2.

REFERENCE SIGNS LIST

1 golf club head
2 face portion
2A upper edge
2B lower edge
9 head main body
10 face member
11 crown-side welded part
12 sole-side welded part
13 sole-side thin area
14 crown-side thin area
F club face
O opening

The invention claimed is:

1. A golf club head for a fairway wood or alternatively a utility type club head, said golf club head having a hollow structure comprising a face portion having a club face for hitting a ball, a crown portion connecting the face portion at an upper edge thereof and forming an upper surface of the club head, and a sole portion connecting the face portion at a lower edge thereof and forming an under surface of the club head, and being composed of a head main body including a part of the face portion provided with an opening, and a face member fitted in the opening and welded to the head main body, wherein a front surface and a back surface of the face member define a part of the club face and a part of a back surface of the face portion, respectively, a thickness of the face member defined between said front surface and said back surface is constant, a welded part between the face member and the head main body includes:

a crown-side welded part positioned substantially at the upper edge or alternatively spaced apart from the upper edge toward the lower edge by a certain distance (A), and a sole-side welded part spaced apart from the lower edge toward the upper edge by a certain distance B which is more than zero and more than the distance (A), wherein:

the distance (A) is defined by a distance measured in the up-down direction of the head between a widthwise center of the crown-side welded part appearing in the club face and the upper edge of the face portion, and the distance B is defined by a distance measured in the up-down direction of the head between a widthwise center of the sole-side welded part appearing in the club face and the lower edge of the face portion, the face portion is provided between the sole-side welded part and the lower edge with a sole-side thin area whose thickness is less than the constant thickness of the face member, wherein, the front surface and the back surface of the sole-side thin area define a part of the club face and a part of the back surface, respectively, of the face portion, and the thickness of the sole-side thin area is defined between said front surface and said back surface, the face portion is provided between the crown-side welded part and the upper edge with a crown-side thin area whose thickness is less than the constant thickness of the face member, wherein the front surface and the back surface of the crown-side thin area define a part of the club face and a part of the back surface, respectively, of the face portion, and the thickness of the crown-side thin area is defined between said front surface and said back surface of the crown-side thin area, the sole-side thin area and the crown-side thin area are formed from said part of the face portion provided with the opening, the thickness of the sole-side thin area is less than the thickness of the crown-side thin area, the thickness of the sole-side thin area is 70% to 95% of the constant thickness of the face member, a length of the sole-side thin area measured in a toe-heel direction of the head is not less than 50% and not more than 90% of the length of the club face measured in the toe-heel direction at the position of a sweet spot of the club face, and a length of the crown-side thin area measured in the toe-heel direction is not less than 80% of the length of the club face.

2. The golf club head according to claim 1, wherein the thickness of the sole-side thin area is 0.5 to 2.0 mm.

3. The golf club head according to claim 2, wherein the distance B is not less than 5 mm, and the distance (A) is not more than 3 mm.

4. The golf club head according to claim 3, wherein the distance B is not less than 15% of a height of the club head, and the distance (A) is not more than 5% of the height of the club head.

5. The golf club head according to claim 1, wherein the distance B is not less than 5 mm, and the distance (A) is not more than 3 mm.

6. The golf club head according to claim 5, wherein the distance B is not less than 15% of a height of the club head, and the distance (A) is not more than 5% of the height of the club head.

7. The golf club head according to claim 1, wherein the distance B is not less than 15% of a height of the club head, and the distance (A) is not more than 5% of the height of the club head.

8. The golf club head according to claim 7, wherein the thickness of the sole-side thin area is 0.5 to 2.0 mm.

9. The golf club head according to claim 1, wherein a difference of the distance B from the distance (A) is more than 2 mm.

10. A golf club head for a fairway wood or alternatively a utility type club head, said golf club head having a hollow structure having an inner cavity, the hollow structure comprising:

a face portion having a club face for hitting a ball;

a crown portion connecting the face portion at an upper edge thereof and forming an upper surface of the club head; and a sole portion connecting the face portion at a lower edge thereof and forming an under surface of the club head, said golf club head being composed of:

a head main body including a part of the face portion provided with an opening, and a face member fitted in the opening and welded to the head main body, wherein a front surface and a back surface of the face member define a part of the club face and a part of a back surface of the face portion, respectively, the thickness of the face member defined between said front surface and said back surface is constant, a welded part between the face member and the head main body includes:

a crown-side welded part positioned substantially at the upper edge or alternatively spaced apart from the upper edge toward the lower edge by a certain distance (A), and a sole-side welded part spaced apart from the lower edge toward the upper edge by a certain distance B which is more than zero and more than the distance (A), wherein:

the distance (A) is defined by a distance measured in the up-down direction of the head between a widthwise center of the crown-side welded part appearing in the club face and the upper edge of the face portion, and the distance B is defined by a distance measured in the up-down direction of the head between a widthwise center of the sole-side welded part appearing in the club face and the lower edge of the face portion, in the welded part between the face member and the head main body, a gap formed therebetween is filled with a weld metal, the face portion is provided between the sole-side welded part and the lower edge with a sole-side thin area whose thickness is less than the constant thickness of the face member, wherein, the front surface and the back surface of the sole-side thin area define a part of the club face and a part of the back surface, respectively, of the face portion, and the thickness of the sole-side thin area is defined between said front surface and said back surface, the face portion is provided between the crown-side welded part and the upper edge with a crown-side thin area whose thickness is less than the constant thickness of the face member, wherein, the front surface and the back surface of the crown-side thin area define a part of the club face and a part of the back surface, respectively, of the face portion, and the thickness of the crown-side thin area is defined between said front surface and said back surface of the crown-side thin area, the sole-side thin area and the crown-side thin area are formed from said part of the face portion provided with the opening, the thickness of the sole-side thin area is less than the thickness of the crown-side thin area, the thickness of the sole-side thin area is 70% to 95% of the constant thickness of the face member, in the sole-side welded part, the weld metal reaches to said inner cavity so that, by the weld metal between the sole-side thin area and the face member, the face portion is provided at a position of the sole-side welded part with a thickness more than the thickness of the sole-side thin area and less than the thickness of the face member to make the thickness change from the sole-side thin area to the face member gradual, a length of the sole-side thin area measured in a toe-heel direction of the head is not less than 50% and not more than 90% of the length of the club face measured in the toe-heel direction at the position of a sweet spot of the club face, and a length of the crown-side thin area measured in the toe-heel direction is not less than 80% of the length of the club face.

* * * * *